United States Patent [19]

Safrit et al.

[11] Patent Number: 4,624,115

[45] Date of Patent: Nov. 25, 1986

[54] SEAMLESS BLANK FOR BODY GARMENT AND METHOD OF FORMING SAME

[75] Inventors: Sam C. Safrit, Pfafftown; Roscoe M. Farrell, Pittsboro; Melvin C. Euliss, Burlington, all of N.C.

[73] Assignee: Kayser-Roth Hosiery, Inc., Burlington, N.C.

[21] Appl. No.: 715,823

[22] Filed: Mar. 25, 1985

[51] Int. Cl.[4] ..... A41B 9/02; A41B 9/04; D04B 1/24

[52] U.S. Cl. ..... 66/172 R; 66/176; 66/198

[58] Field of Search ..... 2/238, 400, 402, 406, 2/407, 143; 66/176, 177, 172 R, 198, 171

[56] References Cited

U.S. PATENT DOCUMENTS

| | | | |
|---|---|---|---|
| 609,694 | 8/1898 | McGenniss | 2/400 X |
| 2,827,780 | 3/1958 | Mahler | 66/172 R X |
| 3,375,530 | 4/1968 | Matthews et al. | 2/402 |
| 4,009,495 | 3/1977 | Faust | 2/406 |
| 4,038,840 | 8/1977 | Castello | 66/172 X |
| 4,043,156 | 8/1977 | Pernick | 66/177 |

FOREIGN PATENT DOCUMENTS

| | | | |
|---|---|---|---|
| 2431265 | 3/1980 | France | 2/402 |
| 978810 | 12/1964 | United Kingdom | 66/178 |
| 1246500 | 9/1971 | United Kingdom | 66/176 |

*Primary Examiner*—Wm. Carter Reynolds

*Attorney, Agent, or Firm*—Bell, Seltzer, Park & Gibson

[57] ABSTRACT

The present seamless knit tubular blank is particularly adapted for use in forming body garments, such as panties and the like. In one embodiment, the panty is formed of a single seamless tubular blank while a second embodiment of the panty is formed of two seamless tubular blanks. In each embodiment, the seamless tubular blanks are provided with a visual cutting guide which is formed during knitting of the blank for providing a visually detectable different appearance and a visual separation between first and second fabric portions of the blank. The second fabric portions of the blank are adapted to be removed from the first fabric portions to impart the requisite shape to the first fabric portions for use in forming the body garment. The special stitch loop construction may be provided only along the juncture of the first and second fabric portions or may be repeated throughout the second fabric portion to provide a clearly defined visually detectable different appearance between the first and second fabric portions.

5 Claims, 10 Drawing Figures

SEAMLESS BLANK FOR BODY GARMENT AND METHOD OF FORMING SAME

FIELD OF THE INVENTION

This invention relates generally to a seamless knit tubular blank for use in forming a body garment and to the method of knitting and cutting the blank, and more particularly to such a blank and method wherein a visual cutting guide is formed in the blank during the knitting operation to provide a guide for removing one or more fabric portions of the blank to impart the requisite shape to the blank in forming the body garment.

BACKGROUND OF THE INVENTION

It is generally known to form either coursewise or walewise extending lines of special stitches in seamless knit tubular blanks for guiding an operator in cutting coursewise openings or walewise slits in the knit blanks when forming garments therefrom. It is also known to form body garments, such as panties and the like, from seamless knit tubular blanks by cutting away one or more portions of the blank to form leg openings in the panty.

For example, Matthews et al U.S. Pat. No. 3,375,530 discloses a knit panty and method of forming the same wherein a seamless tubular knit blank is first knit and then drawn over an elongate cutting board having an inwardly curved notch formed along one side thereof. The portion of the blank in the area of the inwardly curved notch is cut away and the adjacent upper and lower portions of the tubular blank are longitudinally slit and sewn together so that the cut-away portion of the tubular blank forms the leg openings in the panty. However, the cost of producing panties in accordance with the Matthews et al patent is increased by the cost of providing the elongate cutting boards, and the additional labor required in drawing the tubular blanks onto the elongate cutting board, forming the cut therein and then removing the blank therefrom.

The panty type brief disclosed in the Beard et al U.S. Pat. No. 3,491,375 is formed from a seamless knit tubular blank which is flattened out and a pattern guide or mask is positioned on the flattened tubular blank and a line is drawn around the mask to provide a cutting guide for cutting away one or more portions of the tubular blank and removing the same so that the cut-away portions form the leg openings in the panty. The cost of producing the panty in accordance with the Beard et al patent is also increased by the cost of providing the pattern guide or mask, and by the additional operational step of outlining the pattern guide on the knit material to form the guide for cutting and removing portions of the tubular blank.

SUMMARY OF THE INVENTION

With the foregoing in mind, it is an object of the present invention to provide a seamless knit tubular blank for use in forming a body garment and the method of knitting the same wherein a visual cutting guide is formed in the tubular blank during the knitting operation to provide a guide for removal of one or more fabric portions of the blank to impart the requisite shape to the blank for forming the body garment therefrom.

The seamless knit tubular blank includes a first fabric portion adapted to define at least one panel of the body garment and at least one second portion adapted to be removed from the first fabric portion. The visual cutting guide is formed by knitting the first fabric portion of the blank of a first stitch loop construction and knitting at least the juncture of the first and second fabric portions of the blank of a second stitch loop construction which provides a visually detectable different appearance from the first stitch loop construction so that the visual cutting guide is clearly detectable by a cutting and sewing operator. In one illustrated embodiment, both the first and second knit fabric portions are knit of the first stitch loop construction and only the juncture of the first and second fabric portions is knit with a second stitch loop construction formed in selected courses and wales to provide a sinuous guideline extending along the juncture of the first and second fabric portions. In a second illustrated embodiment, the first fabric portion is knit of a first stitch loop construction while the entire second fabric portion is knit of a second stitch loop construction so that the entire second fabric portion provides a visually detectable different appearance from the first stitch loop construction in the first fabric portion to thereby clearly indicate to the cutting and sewing operator the fabric portion to be removed to impart the requisite shape to at least one panel of the body garment.

The seamless knit tubular blank is illustrated as being adapted to form a panty-type body garment. In one embodiment, the panty is formed from a single seamless knit tubular blank with portions to be removed from opposite side portions thereof for forming leg openings in the blank. In a second embodiment, the panty is formed of a pair of seamless knit tubular blanks with each of the tubular blanks including a single portion at one side of the blank to be removed to form the leg openings when the two tubular blanks are joined together along adjacent side portions thereof.

The first stitch loop construction is illustrated as being plain jersey stitch loops while the second stitch loop construction is illustrated as being tuck loops. In one instance the tuck loops are illustrated as being formed in selected wales and courses only along the juncture of the first and second portions of the tubular blank. In another instance the tuck loops extend in a regularly repeating pattern throughout the entire area of the second portion to provide a mesh stitch appearance to the second portion.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

In each illustrated embodiment of the panty, one or two seamless knit tubular blanks are used in forming the panty. Each of the tubular blanks includes a first fabric portion adapted to define at least one panel of the panty and each blank is provided with a second fabric portion adapted to be removed from the first fabric portion to impart to the first portion the requisite shape for use of the first fabric portion in forming the panty. The first fabric portion of the blank is knit of a first stitch loop construction and at least the juncture of the first and second fabric portions is knit of a second stitch construction providing a visually detectable different appearance from the first stitch loop construction to define a visual separation between the first and second fabric portions and a guide for the cutting and sewing operator to remove the second fabric portion to impart the requisite shape to the first fabric portion in forming the panty.

Figure 1:
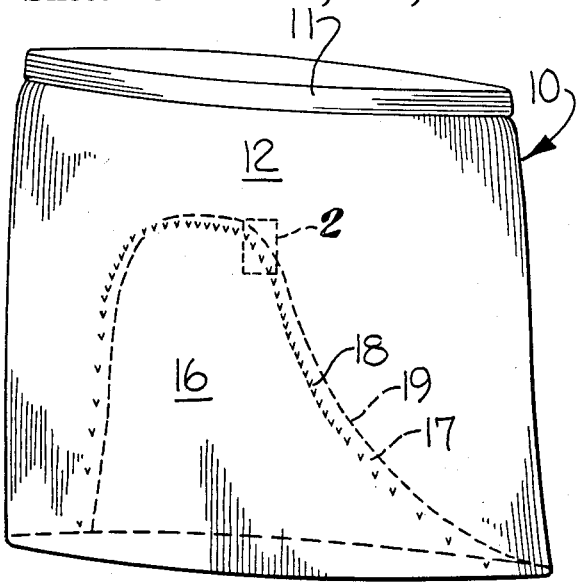
FIG. 1 is a perspective view of one side of a first embodiment of the seamless knit tubular blank of the present invention.
Figure 5:
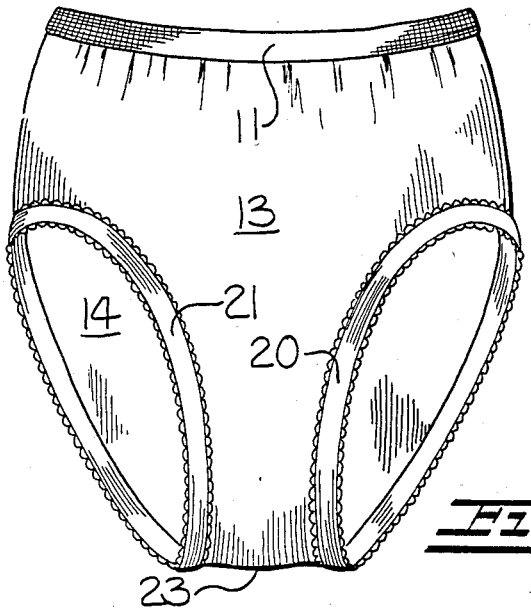
FIG. 5 is an elevational view of the finished panty of the present invention formed from either of the seamless knit tubular blanks shown in FIGS. 1 or 3.

The first embodiment of a seamless knit tubular blank, broadly indicated at 10 in FIG. 1, is knit on a relatively large diameter circular knitting machine to provide a suitable waistband 11 at the upper end thereof. The waistband 11 may be of the turned welt type and may have elastic yarn incorporated therein by any known method, if desired. The blank 10 includes a first fabric portion 12 adapted to define the respective front and rear panels 13, 14 of the finished panty (FIG. 5). A second fabric portion, indicated at separate areas 16, 17 on opposite sides of the blank 10, is adapted to be removed from the first fabric portion 12 in forming the panty. Respective guide or juncture lines 18, 19 extend between the first and second fabric portions 12 and 16, 17 and clearly delineate the adjacent portions from each other.

Figure 2:
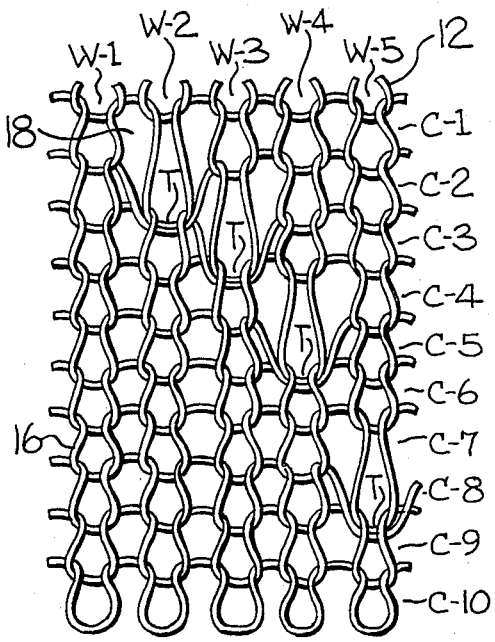
FIG. 2 is a greatly enlarged fragmentary elevational view of the stitch loop construction in the small area of the fabric enclosed in the rectangle 2 in FIG. 1.

The first and second fabric portions 12 and 16, 17 are knit substantially throughout of plain jersey stitch loops, as illustrated in FIG. 2, while the juncture lines 18, 19 are formed by forming tuck loops T in selected courses and wales. The sinuous guide lines 18, 19 of tuck loops T provide a visually detectable different appearance from the plain jersey stitch loops to define a visual separation between the first and second fabric portions 12 and 16, 17 so that the cutting and sewing operator may use the guide lines 18, 19 in removing the second fabric portions 16, 17 from the blank to impart the desired shape to the first fabric portion 12 and form leg openings therein, in a manner to be presently described.

During the knitting of the seamless tubular blank 10, the sinuous guide lines 18, 19 are formed by knitting tuck loops T in selected courses and wales, as illustrated in FIG. 2 and these tuck loops T form a visually detectable different appearance along the juncture of the first and second fabric portions 12 and 16, 17 to guide the cutting and sewing operator in forming the leg openings and attaching elastic bands or tapes thereon. Upon completion of the knitting of the blank 10, the cutting and sewing operator starts at one end of one of the sinuous guide lines 18, 19 and simultaneously cuts and removes the corresponding second fabric portions 16, 17. While cutting along the guide line 18, 19, the cutting and sewing operation simultaneously attaches a decorative elastic tape, as indicated at 20 in FIG. 5, to one leg opening while following the sinuous guide line. The cutting and sewing operator then follows along the other guide line to simultaneously remove the second fabric portion and apply a second decorative elastic tape, as illustrated at 21 in FIG. 5, to form the other leg opening. The lower edge portions of the front panel 13 and the rear panel 14 are then joined together by a transverse seam line, as indicated at 23 in FIG. 5, to complete the formation of the panty. The seam line 23 also connects together the lower ends of the elastic tapes 20, 21.

Figure 3:
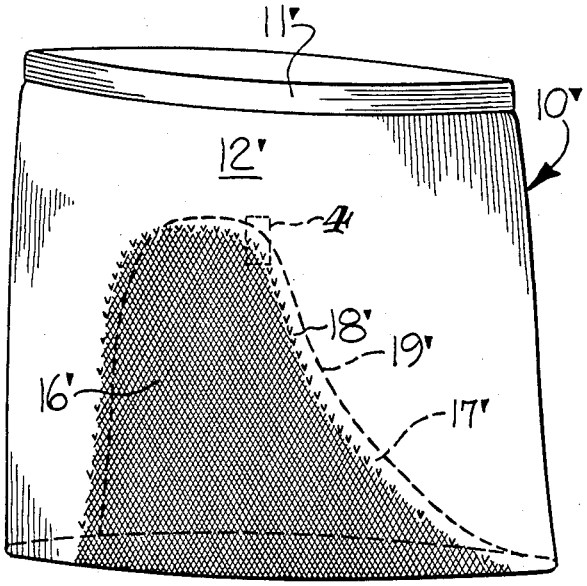
FIG. 3 is a perspective view of one side of a second embodiment of the seamless knit tubular blank of the present invention.
Figure 4:
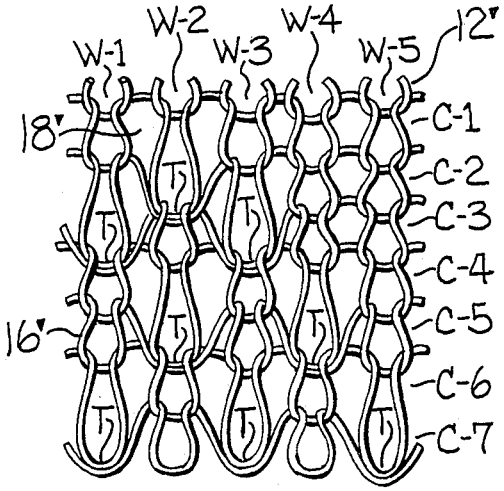
FIG. 4 is a greatly enlarged fragmentary elevational view of the stitch loop construction in the small area enclosed in the rectangle 4 in FIG. 3.

The embodiment of the seamless knit tubular blank, indicated broadly at 10' in FIG. 3, is very similar to the tubular blank 10 in FIG. 1 and corresponding parts will bear like reference characters with the prime notation added. The first fabric portion 12' is illustrated in FIG. 4 as being knit throughout of plain jersey stitch loops while the second fabric portions 16', 17' are knit throughout with a regular repeating pattern of tuck loops T with the outermost tuck loops T defining the respective guide or juncture lines 18', 19' extending between the second fabric portions 16', 17' and the first fabric portion 12'. The regularly repeating tuck loops T in the second fabric portions 16', 17' provide a mesh appearance to these portions and provide a visually detectable different appearance from the knit stitch loop construction of the first fabric portion 12' and thereby form an easily detectable guide for the cutting and sewing operator to remove these fabric portions and simultaneously apply the decorative elastic tapes to the leg openings. After the second fabric portions 16', 17' have been removed, and the elastic tapes applied thereto, the lower portions of the front and rear panels and the lower ends of the elastic tapes are seamed together with a seam, such as illustrated at 23 in FIG. 5, to complete the formation of the panty.

Figure 6:
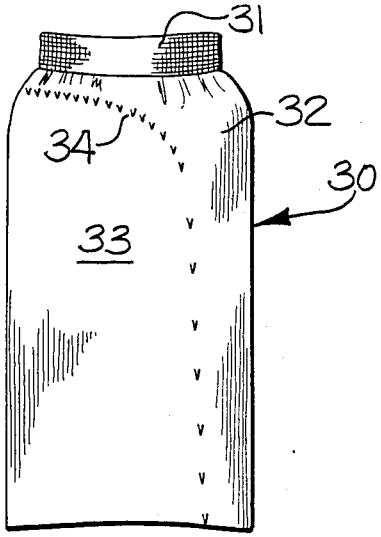
FIGS. 6 and 7 are elevational views of flattened seamless knit tubular blanks for forming a second embodiment of the panty and illustrating the visually detectable juncture lines being formed on opposite sides of the blanks.
Figure 10:
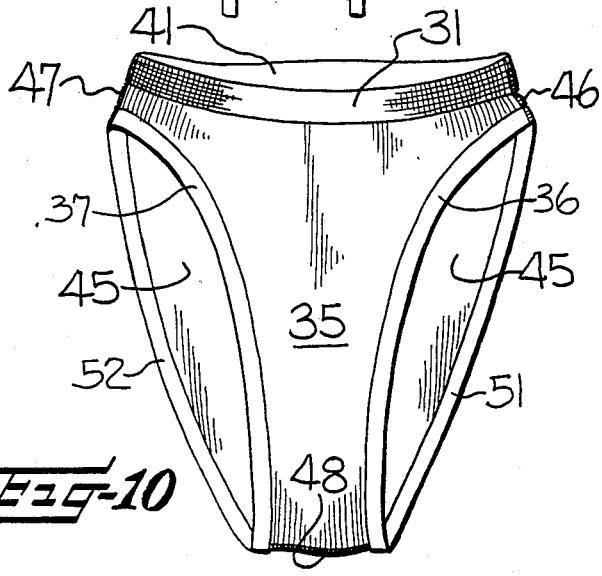
FIG. 10 is a front elevational view of the finished panty formed from the blanks of FIGS. 8 and 9.

The embodiment of the seamless knit tubular blank, broadly indicated at 30 in FIG. 6, is adapted to form the front panel of the panty of FIG. 10 and includes a waistband 31 at the upper end thereof, a first fabric portion 32, and a second fabric portion 33 adapted to be removed from the first fabric portion 32 to impart the proper shape to the first fabric portion 32 in forming the front panel of the panty. A special stitch loop construction, in the form of tuck loops, is formed along the juncture of the first and second fabric portions 32, 33 to define a sinuous guide line indicated at 34. The opposite side of the blank 30 from that shown in FIG. 6 also includes the same type of sinuous guide line 34 which underlies the guide line shown. During the knitting of the seamless knit tubular blank 30, tuck loops are selectively formed in selected wales and courses to form the sinuous guide line 34.

Figure 7:
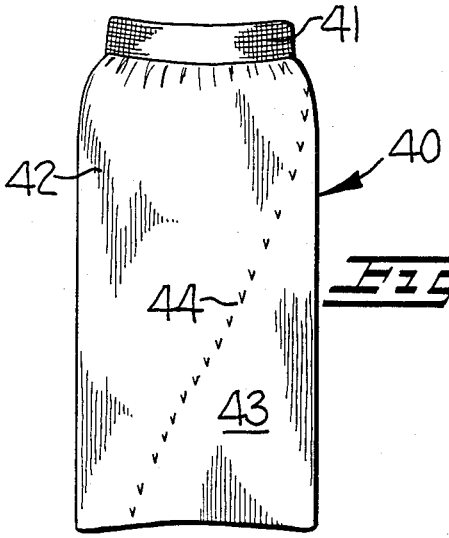

The embodiment of the seamless knit tubular blank, broadly indicated at 40 in FIG. 7, is adapted to form the rear panel of the panty of FIG. 10 and includes a waistband 41, a first fabric portion 42, and a second fabric portion 43 adapted to be removed from the first fabric portion 42 to impart the desired shape to the first fabric portion 42 for forming the rear panel of the panty. During the knitting of the seamless knit tubular blank 40, tuck loops are formed in selected courses and wales to provide a sinuous guide line 44 which extends in the same position along opposite sides of the tubular blank illustrated in FIG. 7. This sinuous guide line 44 provides a visually detectable guide line extending along the juncture of the first and second fabric portions 42, 43 for guiding the cutting and sewing operator in removal of the second fabric portion 43 from the first fabric portion 42 and simultaneously applying a decorative elastic tape thereto.

Figure 8:
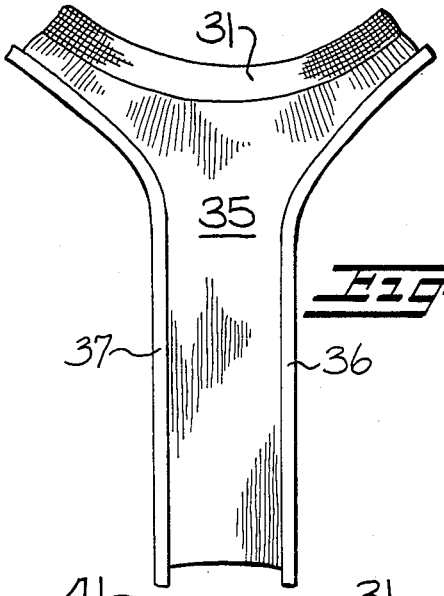
FIGS. 8 and 9 are elevational views of the respective blanks shown in FIGS. 6 and 7, after the second portions have been removed from each of the blanks to form respective front and rear panels therefrom.
Figure 9:
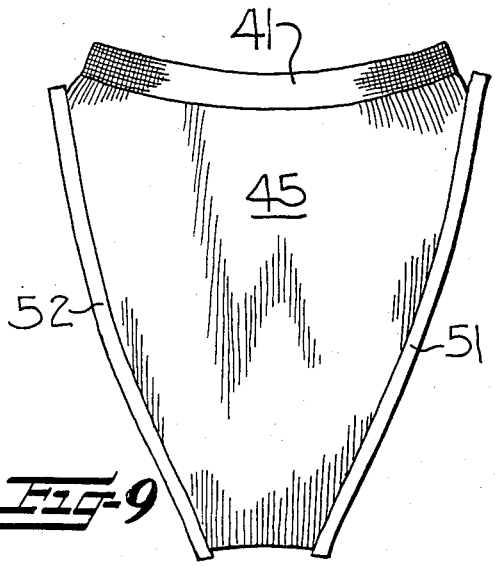

To form the respective front and rear panels of FIGS. 8 and 9, the upper end portions of the respective blanks 30, 40 are slit in a walewise direction and downwardly from the waist bands 31, 41 to a position below the respective guide lines 34, 44. The cutting and sewing operator then simultaneously cuts and attaches decorative elastic tapes 36, 37 along the guide lines 34, as illustrated in FIG. 8, to form a front panel 35. The operator then simultaneously cuts and attaches decorative elastic tapes 51, 52 along the guide lines 44, as illustrated in FIG. 9, to form a rear panel 45. The front panel 35 is then superimposed upon the rear panel 45 and side seams, indicated at 46, 47 are formed to attach the respective waistband portions 31, 41 together at opposite ends thereof and to join together upper ends of the elastic tapes 36, 51 and 37, 52 around the leg openings. A transverse seam 48 is then formed across the lower ends of the front and rear panels 35, 45 and also connects together the lower ends of the elastic tapes 36, 51 and 37, 52 around the leg openings to complete the formation of the panty.

Thus, in the illustrated embodiments of the invention, the panty is formed of one or two seamless knit tubular blanks which are knit with guide lines for cutting and sewing the garment blank. The guide lines are formed during the knitting of the blanks so that it is not necessary to provide special boards or pattern guides for marking and then cutting the tubular blanks in the formation of panties and the like. While tuck loops are illustrated as a special type of stitch loop construction which may be used to either form the guide lines along the juncture of the first and second fabric portions or for forming one or both of the fabric portions to be removed, it is to be understood that other types of special stitch loop construction may also be utilized to form the cutting and sewing guide lines during the knitting of the tubular blanks.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A seamless knit tubular blank for use in forming a body garment, said blank comprising a first fabric portion adapted to define at least one panel of the body garment and at least one second fabric portion adapted to be cut away and removed from said first fabric portion to impart to said first fabric portion the requisite shape for use of said first fabric portion in forming the body garment, said first fabric portion of said blank being knit of a first stitch loop construction, and said second fabric portion being knit of a second stitch loop construction extending throughout the entire area of said second fabric portion, said first and second stitch loop constructions providing a visually detectable different appearance along the juncture between said first and second fabric portions, said second stitch loop construction being formed in selected wales of selected courses and forming a sinuous guide line for cutting and removal of said second fabric portion to impart said requisite shape to said first fabric portion.

2. A seamless knit tubular blank according to claim 1 wherein said second stitch loop construction comprises a regularly repeating pattern of tuck loops extending throughout the entire area of said second fabric portion.

3. A seamless knit tubular blank according to claim 1 particularly adapted for use in forming a panty garment, and wherein said blank comprises a single first fabric portion adapted to define front and rear panels of the panty, and wherein spaced-apart second fabric portions are provided on opposite sides of said tubular blank and are adapted to be removed for forming leg openings in said panty.

4. A method of knitting a seamless tubular blank for use in forming a body garment wherein said blank includes a first fabric portion adapted to define at least one panel of the body garment, and at least one second fabric portion adapted to be cut away and removed from said first fabric portion to impart to said first fabric portion the requisite shape for use of said first fabric portion in forming the body garment, said method comprising the steps of knitting a seamless tubular blank while forming said first fabric portion of said blank of a first stitch loop construction, while forming said second fabric portion of a second stitch loop construction extending throughout the entire area of said second fabric portion, said first and second stitch loop constructions providing a visually detectable different appearance along the juncture between said first and second fabric portions, and while forming said second stitch loop construction in selected wales of selected courses and forming a sinuous guide line for cutting and removal of said second fabric portion to impart said requisite shape to said first fabric portion.

5. A method according to claim 4 wherein said second stitch loop construction is knit throughout the entire area of said second fabric portion by forming a regularly repeating pattern of tuck loops.

* * * * *